United States Patent [19]

Rinninger

[11] Patent Number: 4,792,257

[45] Date of Patent: Dec. 20, 1988

[54] SET OF PAVING STONES, PARTICULARLY SET OF CONCRETE PAVING STONES

[75] Inventor: Hans Rinninger, Kisslegg, Fed. Rep. of Germany

[73] Assignee: Hans Rinninger u. Sohn GmbH u. Co., Kisslegg, Fed. Rep. of Germany

[21] Appl. No.: 95,190

[22] Filed: Sep. 11, 1987

[30] Foreign Application Priority Data

Sep. 12, 1986 [DE] Fed. Rep. of Germany ..... 252

[51] Int. Cl.[4] ..... E01C 5/00

[52] U.S. Cl. ..... 404/41; 404/42; 404/39; 52/384; 52/392

[58] Field of Search ..... 404/34, 37–39, 404/41–44; 52/311, 384, 391, 392

[56] References Cited

U.S. PATENT DOCUMENTS

| | | | |
|---|---|---|---|
| 1,139,934 | 5/1915 | Von Mollenbruck | 52/311 |
| 1,268,123 | 6/1918 | Innes | 404/38 |
| 3,494,266 | 2/1970 | Baumberger | 404/42 X |
| 4,572,699 | 2/1986 | Rinninger | 404/42 |

FOREIGN PATENT DOCUMENTS

| | | | |
|---|---|---|---|
| 227144 | 7/1987 | European Pat. Off. | 404/34 |
| 2922393 | 12/1979 | Fed. Rep. of Germany . | |
| 3326109 | 2/1985 | Fed. Rep. of Germany | 404/42 |

*Primary Examiner*—Stephen J. Novosad
*Assistant Examiner*—John F. Letchford
*Attorney, Agent, or Firm*—Spencer & Frank

[57] ABSTRACT

A paving stone set includes a square paving-stone, a larger rectangular paving-stone and a smaller rectangular paving-stone. Each of the paving stones has generally planar top and bottom surfaces and generally planar side walls, with a clothoid shaped surface being formed on two corners of each paving-stone. The radius of curvature of each clothoid shaped surface may be different from that of the other clothoid shaped surfaces on each paving-stone. The top surface may have a different color and texture than the bottom surface. The paving-stones may be irregularly broken surfaces.

13 Claims, 2 Drawing Sheets

SET OF PAVING STONES, PARTICULARLY SET OF CONCRETE PAVING STONES

BACKGROUND OF THE INVENTION

The invention relates to a paving-stone set, especially a concrete paving-stone set for constructing garden layouts, paths or the like with paving stones of which the side faces and upper and lower faces are made plane and the transitional region between a side face and the upper or lower faces is made substantially sharp-edged or rounded.

The external shaping of concrete paving stones is governed by both technical and visual factors. Thus, paving stones with plane side faces are produced in a square or rectangular basic chape, so that the paving stones, when laid in a composite structure over the entire surface, are supported against one another, thus ensuring a firm bond. Moreover, during laying, directional stability is improved in comparison with stones having curved outer contours, and a more efficient utilization of shape and of area is guaranteed. Furthermore, the advantage of plane outer contours is that the molds for producing the paving stones are cheaper. In addition, plane outer faces guarantee the greatest possible bundling capacity.

However, a laid surface with completely plane outer contours gives the observer a very monotonous impression, and because of this known paving stones (U.S. Pat. No. 4,572,699) are provided with a specific paving-stone head structure. This can be obtained by means of rounded edges, drawn-down corner regions, wavy recesses or the like.

Another advantage of plane side faces is that the stones can be laid very easily in a composite structure, since the side faces are supported against one another. Furthermore, good directional stability and alignment of the stones are possible during laying. However, the disadvantage of plane side faces is that between the individual paving stones there is little free space for water to run off or to seep away into the subsoil or for the possible growing of grass. Known paving stones are therefore sometimes given curved outer contours. But this entails the disadvantages mentioned above.

The object on which the invention is based is to provide a paving stone with substantially plane outer contours, that is to say an upper and a lower face and side faces, but of shaping which allows existence interspaces between the paving stones laid against one another. At the same time, the shaping will be such that a completely irregular appearance is obtained in the laid state.

SUMMARY OF THE INVENTION

According to the invention, this object is achieved because at least two side faces located opposite one another or adjoining one another are made rounded towards at least one corner region, the rounding, as seen in plan view, being shaped as a curve with a radius of curvature decreasing constantly towards the corner regions (this is known as a clothoid shape, which is also known as Cornu's spiral).

The advantage of the paving stone according to the invention is that the plane side faces makes it possible to ensure good laying in a composite structure, since the stones butt against one another in the laid state. The rounding in the form of a curve which decreases constantly towards the corner regions (clothoid) gives the stone shape a completely irregular appearance, thereby avoiding a monotonous aspect. At the same time, the clothoids are distributed completely irregularly in the particular corner regions of the paving stones, so that virtually every paving stone has a different effect. Also, one and the same paving stone itself has a different effect, depending on where the clothoid comes to rest in the laid composite structure, that is to say as a result of the rotation of the paving stone. The recess created as a result of the rounding in the corner region then allows water to flow off easily and, if appropriate, make it possible to grow plants or grass in this region. If the rounding were made as a conventional rounding of constant radius or simply as a constant bevel, the stone shape would not guarantee the desired visual effect, together with the associated possibilities of good water flow-off and growth of plants. In particular, such a paving stone would also always have the same effect, when rotated.

Advantageous developments and improvements of the paving-stone set indicated in the above are contemplated as being within the scope of the present invention.

The clothoid-shaped curvature is restricted to approximately $\frac{1}{4}$ to 1/6 of the total side length. As a result, the main side face remains plane, thus affording the associated advantages during laying and ensuring the associated stability of the laid composite surface.

At least one corner of the paving stone between two side faces can preferably be made sharp-edged and right-angled. This serves for a clear visual delimitation in relation to the clothoid-shaped curvature in the remaining corner regions. Furthermore, a right-angled corner can utilize the area in edge regions in the most efficient way possible.

According to another aspect of the invention, the upper and lower edge between the upper face or lower face and the side faces is made sharp-edged, this sharp edge can also be broken irregularly.

Because the side faces are curved in the form of a clothoid in the corner regions, the paving stone also acquires a crowned rustic visual appearance, this partly being reinforced by the broken edges. At the same time, because of the plane upper face, it is easy to walk on the laid surface and easy to clean it, in particular to clear it of snow, etc, a good grip still being guaranteed by the interspaces formed by the clothoids.

When concrete paving stones are produced in production molds, the transistion between the lower face and side faces is usually made sharp-edged. So that both the side which is the lower during production in the production mold and the upper side subjected to the force of the male die can be used equally as the upper visible side in the laid state, the continuous edges between these two faces and the side faces are each made sharp-edged. The sharp edge is then broken in order to five a rustic appearance. This is achieved by uncontrolled tipping from the motor truck or by means of a special revolving drum, in which the stones knock against one another.

In another embodiment of the present invention, the structure of the face which is the lower in the production mold is made coarser, because of the coarser back concrete, than the upper face which is subjected to the force of the male die of the molding machine and in which a finer facing concrete of another composition is used. Then, if both sides are used at random during laying, this gives a looser appearance, if appropriate with different color structure as a result of the addition of coloring agents to the facing concrete and back concrete.

In another embodiment of the present invention, the paving stones are constructed according to the building-block system, with a square standard stone as seen in plan view, a larger rectangular $1\frac{1}{2}$-size stone as seen in plan view, and with a smaller rectangular half-size stone as seen in plan view.

Of course, the clothoid can also be formed by traversing a polygonal course.

BRIEF DESCRIPTION OF THE DRAWINGS

Exemplary embodiments of the invention are illustrated in the drawing and explained in detail in the following description. In the drawing.

DETAILED DESCRIPTION OF THE PREFERRED EMBODIMENT

Figure 1A:
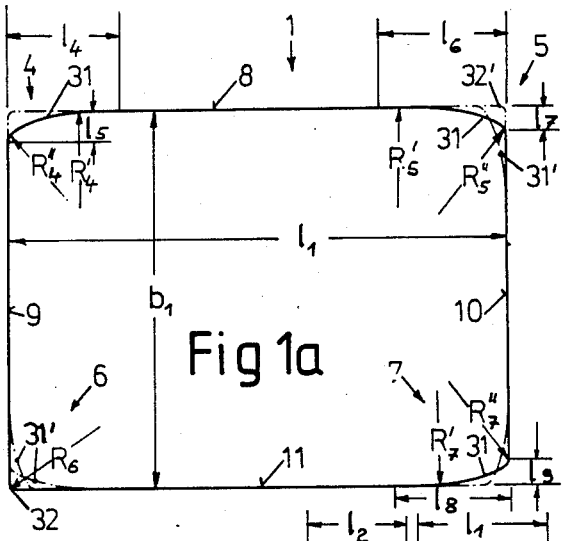
FIGS. 1*a* and 1*b* show a larger rectangular stone in plan view and in a perspective view respectively.

FIG. 1*a* shows a paving stone (1) which is rectangular in its basic cross-section and which has a length of $L_1=238$ mm and a width of $b_1=178$ mm. In conformity with this, the side length of the square stone (2) according to FIG. 2*a* amounts to $L_2=b_2=178$ mm. The length of the small rectangular stone (3) according to FIG. 3*a* amounts to $L_3=178$ mm and the width is $b_3=88$ mm. The lengths $b_1$, $b_2$, $L_2$ and $L_3$ are accordingly the same. The height of the paving stones (1), (2) and (3) amounts to approximately $h\approx 70$ mm.

FIG. 1*a* shows the various possibilities for forming the curves at the side faces (8 to 11) in the corner regions. The corner regions are designated by the reference symbols (4 to 7). At the same time, the actual shaping is marked by an unbroken line, and the shaping which is also possible, if appropriate, is marked by a dot-and-dash line.

In the paving stone (1) (FIG. 1*a*), the corner (4) is designed as a so-called clothoid (31), that is to say the plane side face (8) has, both towards the left-hand corner region (4) and towards the right-hand corner region (5), a rounding which, as seen in plan view, is shaped as a curve with radii of curvature ($R_4$, $R_4'$, $R_4''$ and $R_5$, $R_5'$, $R_5''$) decreasing constantly towards the corner regions. In the corner region (4), for example, the clothoid (31) starts on the side face (8) at a length $L_4\approx 40$ mm with a radius $R_4'\approx 81$ mm and ends on the adjoining plane side face (9) with a length of $L_5\approx 12$ mm and a radius of $R_4''\approx 13$ mm. Accordingly, the radius $R_4$ becomes constantly smaller towards the corner region, this being characteristic for this shaping.

The corner (5) in FIG. 1*a* has, for example a clothoid (31) which starts on the side face (8) at a distance $L_6\approx 45$ mm from the corner region and ends approximately at a length $L_7\approx 7$ mm in the side face (10). The radius at the start of the clothoid (31) is approximately $R_5'\approx 165$ mm and ends in the corner region at $R_5''\approx 7.5$ mm.

The corner region (6) of the stone shape (1) in FIG. 1*a* is designed as a right-angled sharp edge (32) with a rounding of $R_6\approx 4$ mm.

The corner region (7) of the stone shape in FIG. 1*a* has a clothoid form which starts on the longer side face (11) at a distance of $L_8\approx 40$ mm and ends laterally in the side face (10) at a distance $L_9\approx 10$ mm. The maximum radius amounts to, for example, $R_7'\approx 93$ mm, and the minimum radius amounts to $R_7''\approx 11$ mm.

The corner region indicated by dot-and-dash lines in the corner regions (4 to 7) in FIG. 1 represent alternative forms of construction of the clothoids (31') and of the right-angled construction (32') of the corner regions. Thus, the radii of the clothoids (31, 31') can assume highly varied values for different shapes.

Figure 2A:
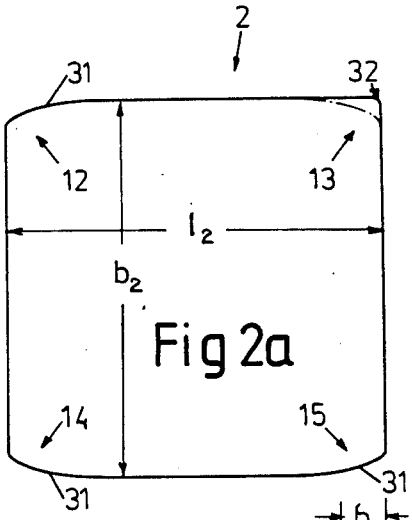
FIGS. 2*a* and 2*b* show a paving stone of square horizontal projection in plan view and in perspective view respectively.

The paving stone (2) of rectangular cross-section, shown in FIG. 2*a*, has corner regions (12 to 15) which are of a basic design similar to or the same as that of the corner regions (4 to 7) of the paving stone (1) in FIG. 1*a*. Thus, in the exemplary embodiment according to FIG. 2*a*, clothoids (31) are provided in the corner regions (12, 14, 15), whilst the corner (13) is made right-angled (32).

Figure 3A:
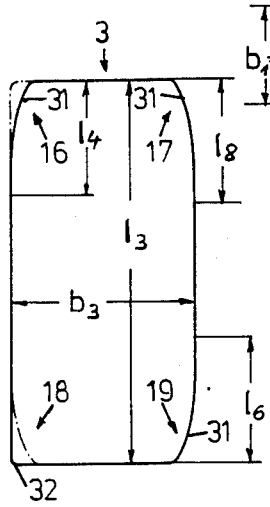
FIGS. 3*a* and 3*b* show a smaller paving stone of rectangular cross-section in plan view and in perspective view respectively.

The same is true of the smaller rectangular paving stone (3) shown in FIG. 3*a*, with the corner regions (16 to 19), the corner region (18) of the paving stone (3) once again being made right-angled (32) without the construction of a clothoid. The lengths of the clothoids (31) are designated by $L_4$, $L_6$ and $L_8$ according to the design in FIG. 1*a*.

As mentioned, the clothoids (31, 31') can have different starting and end radii. The clothoids (31) starts in each case on a side face at a length of $L_4$, $L_6$, $L_8$ of $\frac{1}{4}$ to 1/6 of the total length $L_1$, $b_1$; $L_2$, $b_2$; $L_3$, $b_3$) of the particular side face.

Figure 4:
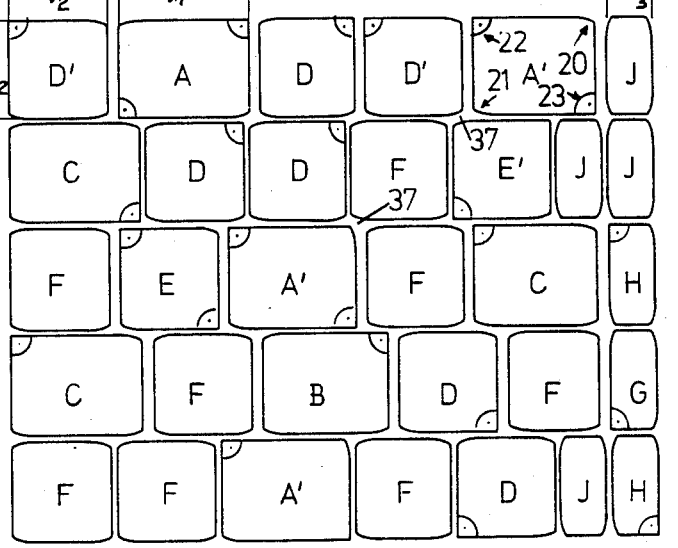
FIG. 4 shows a plan view of a laid surface or a die mold for producing the paving stones.

FIG. 4 shows the different types of paving stones to be formed from FIGS. 1*a* to 3*a*. The different types are identified by the type designation A to J, and the paving stones A' to J' illustrated are formed as a result of a rotation of the paving stone through 180° or a mirror-image representation of the stones A to J. The lower face and the upper face of the paving stone can be used equally as the visible face in the laid state.

The illustration in FIG. 4 also serves to show a laid surface, and for the sake of greater clarity there are distances between the side faces touching one another. In the laid state, the particular side faces are in contact with one another. It can be seen clearly from the illustration in FIG. 4 that marked recesses or cavities (37) are obtained in the corner regions in the zone of the clothoids, particularly also when several clothoids (31) of adjacent stones meet in the corner regions. This results in a sufficiently large gap (37) for water to flow off or, if appropriate, for growing grass on these part surfaces.

The illustration according to FIG. 4 can also serve to show the initial mold or die mold for producing the individual stone shapes or machine shapes with the best possible utilization of the mold area, each die mold being composed of the various stone shapes, as shown in FIG. 4. This guarantees that, during each production operation, the greatly varying stone shapes A to J or A' to J' are produced.

FIGS. 1*b* to 3*b* show the stone shapes according to FIGS. 1*a* to 3*a* in perspective. The larger rectangular stone (1) has a shaping as designated by A' in FIG. 4, that is to say, as seen in plan view the stone has a clothoid (31) only in the upper right-hand corner region

(20) and in the lower left-hand corner region (21). The other two corner regions (22, 23) are made right-angled (32), that is to say the side faces (10' and 11') meet at right angles. This is also true of the side faces (8' and 9').

Figures 1B, 2B, 3B:
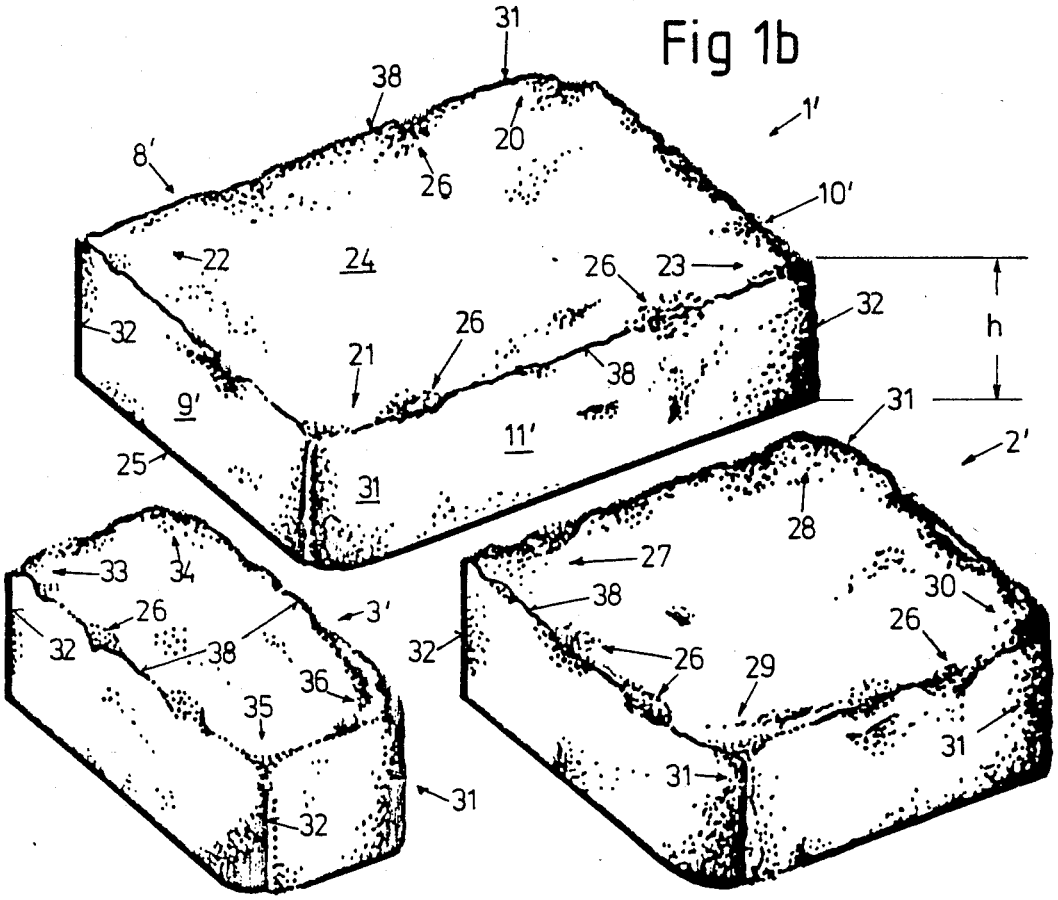

Of the stone shape in FIG. 1*b*, the continuous sharp-edged broken upper edge (38) between the upper visible face (24) and the side faces (8' and 10') is also shown. The same applies to the continuous lower edge (25) to the invisible lower face, this likewise being made continuously sharp-edged and broken, so that the stone can be turned over easily. The broken places (26) are obtained by knocking off the otherwise continuous sharp edge (38, 25) when the paving stones are tipped off from a motor truck onto the ground. However, the paving stones can also be knocked against one another in a drum, so that the edges break irregularly.

The square paving stones (2') and smaller rectangular paving stones (3') shown in FIGS. 2*b* and 3*b* respectively have basically the same design as the paving stone (1') in FIG. 1*b*. The paving stone (2') has clothoids (31) in the corner regions (28 to 30), whilst the corner region (27) is designed as a right-angled corner (32).

The same is true of the corner regions (34 and 36) of the paving stone (3') in FIG. 3*b*, which are designed as clothoids (31), whilst the other two corner regions (33, 35) are designed as right-angled corners (32).

I claim:

1. A paving-stone set for construction of garden layouts, paths and the like, comprising:

a generally square paving-stone, a larger, generally rectangular paving-stone, and a smaller, generally rectangular paving-stone, each of the paving-stones having generally planar side faces, generally planar upper and lower faces, corners at respective intersections of said side faces, and respective top and bottom transitional regions at intersections of said planar side faces with said upper face and said lower face, wherein at least two of said side faces have a clothoid shaped surface extending along a portion of each one of said at least two side faces to a respective nearest one of said corners, each said clothoid shaped surface being a curve having a respective radius of curvature decreasing constantly in a direction towards said nearest one of said corners.

2. A paving-stone set as claimed in claim 1, wherein said clothoid shaped surface extends along said one side face towards said corner for a distance which is within a range of approximately ¼ to 1/6 of a total length of said one side face.

3. A paving-stone set as claimed in claim 1, wherein at least one of said corners at one of the respective intersections of said side faces between two side faces (9, 11) of the paving stone is relatively sharp-edged and in the shape of a right-angled corner.

4. A paving-stone set as claimed in claim 1, wherein at least one of said top and bottom transitional regions is a continuous edge which is relatively sharp-edged.

5. A paving-stone set as claimed in claim 1, wherein at least one of said top and bottom transitional regions is a continuous edge which is relatively sharp-edged and broken irregularly.

6. A paving-stone set as claimed in claim 1, wherein one of said top and bottom faces is relatively coarser than the other one of said top and bottom faces.

7. A paving-stone set as claimed in claim 1, wherein said generally square paving-stone has a first predetermined side length, said larger, generally rectangular paving-stone having a second predetermined side length which is approximately one and one-half times said first predetermined length, and said smaller, generally rectangular paving-stone having a third predetermined side length which is approximately one-half times said first predetermined length.

8. A paving-stone set as claimed in claim 1, wherein said clothoid is formed by traversing a polygonal course.

9. A paving-stone set as claimed in claim 1, wherein said clothoid shaped surface is disposed on two adjacent ones of said corners.

10. A paving-stone set as claimed in claim 1, wherein said clothoid shaped surface is disposed on two opposite ones of said corners.

11. A paving-stone set as claimed in claim 1, wherein one said respective radius of curvature of each of said two side faces is different from the other, whereby two different clothoid shaped surfaces are disposed on the paving-stone.

12. A paving-stone set as claimed in claim 1, wherein at least one said transition region is rounded.

13. A paving-stone set as claimed in claim 1, wherein at least one said transition region is sharp.

* * * * *